United States Patent [19]

Fryberger

[11] Patent Number: 4,736,614

[45] Date of Patent: Apr. 12, 1988

[54] CONNECTOR SUPPORT FOR CRIMPING TOOL

[75] Inventor: Charles T. Fryberger, Somerset County, N.J.

[73] Assignee: Thomas & Betts Corporation, Bridgewater, N.J.

[21] Appl. No.: 855,871

[22] Filed: Apr. 24, 1986

Related U.S. Application Data

[63] Continuation-in-part of Ser. No. 763,853, Sep. 10, 1985, abandoned.

[51] Int. Cl.[4] ..... B21D 7/06

[52] U.S. Cl. ..... 72/410; 29/751; 81/421; 72/461

[58] Field of Search ..... 72/410, 409, 461; 81/418, 420, 421, 424, 9.4, 9.44; 30/90.1; 29/751

[56] References Cited

U.S. PATENT DOCUMENTS

| | | | |
|---|---|---|---|
| 2,738,693 | 3/1956 | Logan | 72/410 |
| 2,765,688 | 10/1956 | Evans | 72/409 |
| 2,991,675 | 7/1961 | Ustin | 72/410 |
| 3,039,337 | 6/1962 | Stuart-Prince | 72/410 |
| 3,049,951 | 8/1962 | Rensink | 29/751 |
| 3,094,702 | 6/1963 | Ustin et al. | 72/409 |
| 3,252,316 | 5/1966 | Haucke | 72/410 |
| 3,523,351 | 8/1970 | Filia | 72/410 |
| 3,553,999 | 1/1971 | Rommel | 72/410 |
| 3,738,150 | 6/1973 | Holmes | 72/410 |
| 4,590,786 | 5/1986 | Wiener et al. | 72/410 |

FOREIGN PATENT DOCUMENTS

| | | | |
|---|---|---|---|
| 663186 | 5/1963 | Canada | 72/410 |
| 1393178 | 2/1965 | France | 72/410 |

*Primary Examiner*—Daniel C. Crane

*Attorney, Agent, or Firm*—Robert M. Rodrick; Salvatore J. Abbruzzese

[57] ABSTRACT

A contact support device is described. The device is attachable to a contact crimping tool and places the electrical contact in position adjacent the jaws of the tool. The device includes a cavity for supporting the contact. The cavity provides polarization of the contact therein and prevents rotation of the contact during crimping.

2 Claims, 6 Drawing Sheets

FIG. 4
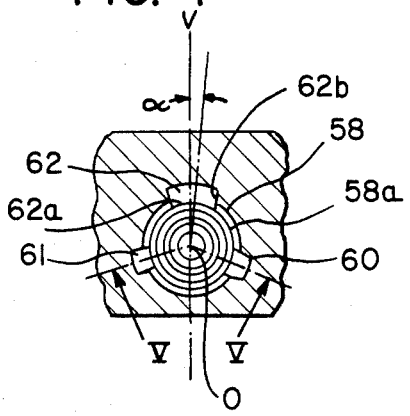
FIG. 5
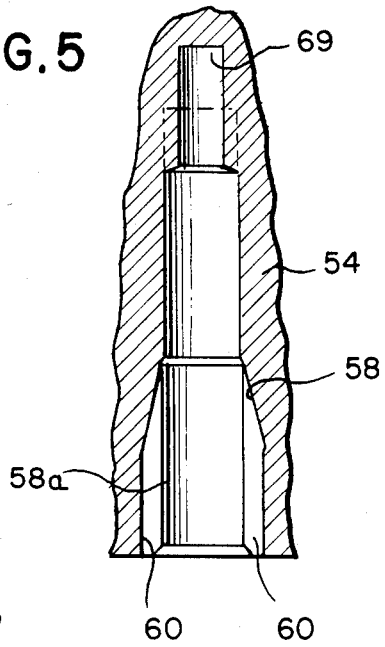
FIG. 3
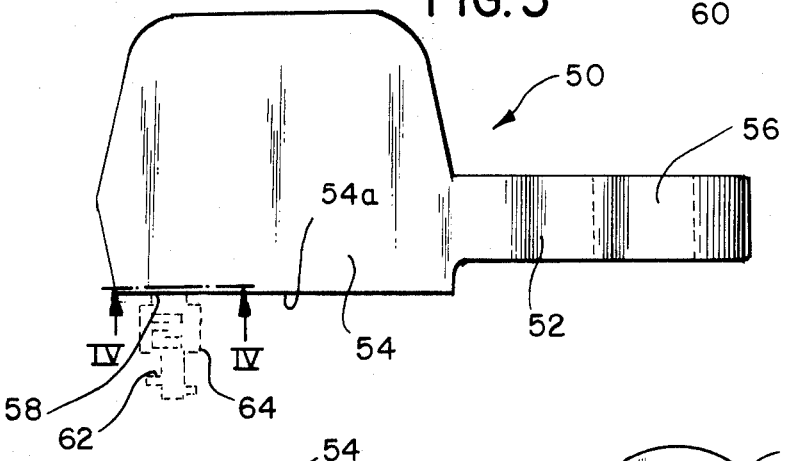
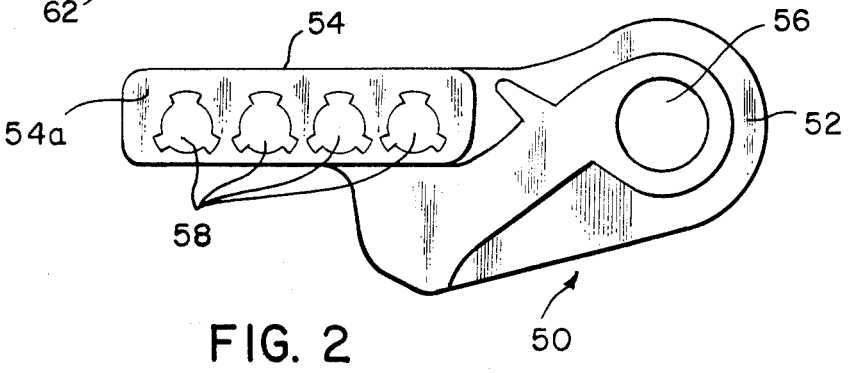
FIG. 2

CONNECTOR SUPPORT FOR CRIMPING TOOL

CROSS REFERENCE TO RELATED APPLICATION

The present application is a continuation in part of Ser. No. 763,853, filed Sept. 10, 1985, now abandoned.

FIELD OF INVENTION

The present invention relates generally to a device attached to a crimping tool to support an electrical connector adjacent crimping dies of the crimping tool. More particularly, the present invention relates to a device which orients and supports an electrical connector adjacent the dies of a crimping tool and prevents rotation of the connector upon the crimping thereof.

BACKGROUND OF THE INVENTION

In the electrical connection art crimping tools are widely known which crimp connectors to the stripped ends of an electrical wire. These tools can be as simple as plier type tools which squeeze a portion of the connector onto the stripped wire or can be as complicated as hydraulic tools which automatically gauge the depth and force at which a connector or terminal is crimped onto a wire.

There is a line of plier type crimping tools which employ plural die nests in the nose thereof to accommodate various sizes of connectors and gauges of wire. To use these tools, typically a connector is inserted into the die nest from one side and a stripped end extent of wire is inserted into the connector from the other side of the die nest. The plier type tool is then squeezed to crimp the wire in the connector. However, as can be seen, it is difficult for a user to support both the connector and the wire while similtaneously squeezing the tool. In response to this perceived problem, the art has developed a holding device which can support the connector and the wire in the die nests while allowing the user to squeeze the handles of the tool. These holders are typically pivotally supported adjacent the die nests so that they can be pivoted in place to support the connector inserted over the end of the wire. For special uses, such as crimping wire splices, the holder can be pivoted out of the way to provide clearance on both sides of the die nest. While these holders have somewhat adequately served the user, an additional problem is encountered in using these conventional holders.

In crimping cylindrical connectors, which as its name implies is a connector having a substantially cylindrical body, the holders typically allow rotation of the cylindrical body in the die nests upon application of a torque-type load which is incidential to crimping the connector. Thus, on the progressive movement of the crimping dies during the crimp cycle, the cylindrical connector may rotate in the holder, thus providing an improper crimp which may result in poor electrical connection. In addition, these cylindrial connectors usually are used with die nests having unique configurations which are typically keyed to a particular orientation of the connector in the die nest. Thus, in the conventional holders found in the prior art, improper orientation of the connector in the die nest may occur. This also will result in an improper crimp and in a poor electrical connection.

It is advantageous to provide a connector holder supportable on a crimping tool which will retain the connector in the holder in a proper orientation with respect to the die nests and which will prevent rotation of the connector in the holder upon progressive crimping of the connector.

SUMMARY OF THE INVENTION

It is an object of the present invention to provide a connector support for a connector crimping tool wherein the connector will be uniquely oriented in the tool between the spaced apart crimping dies.

It is a further object of the present invention to provide a connector support device for a crimping tool which will prevent rotation of a cylindrical connector upon crimping the connector.

In the efficient attainment of these and other objects the present invention looks toward providing a device for supporting an electrical connector for attachment to a connector crimping tool. The device includes a body attachable to the crimping tool adjacent the jaws thereof. The body includes a connector accommodating portion having a longitudinal cavity therein for receipt of the cylindrical connector. The cavity is constructed to position a portion of the connector between the crimping jaws. The connector accommodating portion includes means for providing singular unique orientation of the circular connector in the cavity.

In a more particularly described device, shown by way of preferred embodiment, the connector accommodating portion includes plural cavities therein, each alignable with separate die nests in the jaws of the tool. Each cavity is uniquely configured to accommodate a cylindrical connector therein in a unique orientation to prevent incorrect insertion of the connector into the cavity. The configuration of the cavity further provides an anti-rotation mechanism to prevent the rotation of the connector in the cavity during the crimping cycle. The unique configuration of the cavity also disposes the connector at a predetermined, desirable position for optimum crimping.

BRIEF DESCRIPTION OF THE DRAWINGS

FIGS. 2 and 3 are enlarged front and top showings respectfully of the support device of FIG. 1.

FIG. 4 is a sectional showing of a portion of the support device shown in FIG. 3 taken along the lines IV—IV.

FIG. 5 is a sectional showing of the cavity of the holding device of the present invention taken along the lines V—V of FIG. 4.

DETAILED DESCRIPTION OF THE PREFERRED EMBODIMENT

Figure 1:
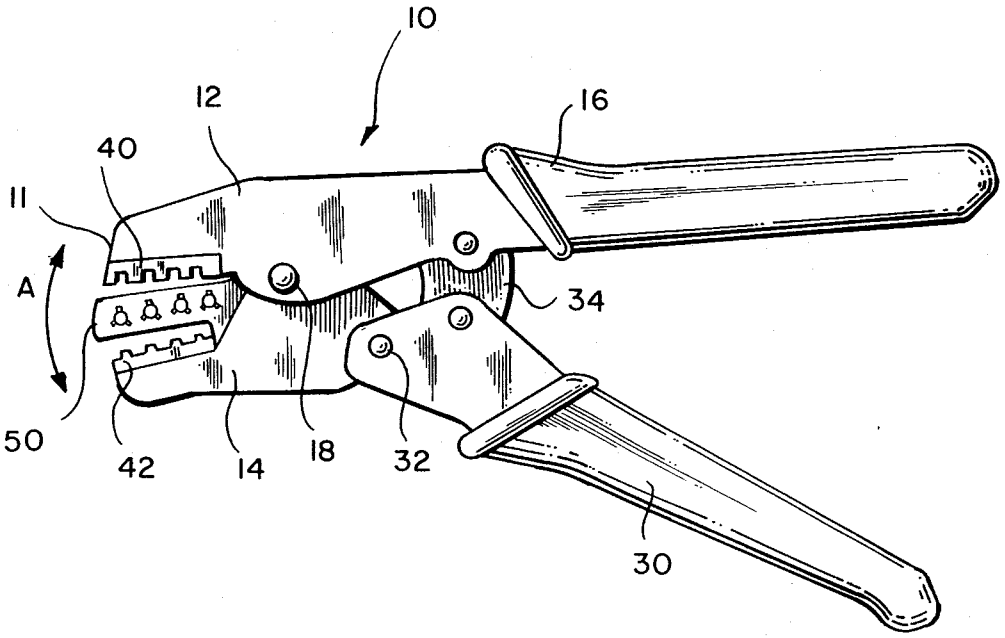
FIG. 1 shows a conventional connector crimping tool including the support device of the present invention.

Referring to FIG. 1, a plier type crimping tool for use with the device of the present invention is shown.

Crimping tool 10 is an elongate member having at one end thereof a nose portion 11 which supports a pair of oppositely directed jaws 12 and 14. First jaw 12 is a stationary non-moveable element supported directly over the moveable second jaw 14. First jaw 12 is provided with an extention portion in the form of first stationary handle 16 which extends substantially linearly with stationary jaw 12. Moveable jaw 14 is pivotally connected to the first jaw 12 at pivot pin 18. An elongate handle 30 is pivotally connected to second jaw 14 at pivot pin 32 for pivotal operational movement of second jaw 14 in relation to stationary jaw 12. A ratchet mechanism shown schematically at 34 is pivotally connected to each of first and second jaws 12 and 14 to provide for ratchet operation of the tool in a manner which is conventional in the crimping tool art. This ratchet operation provides a full stroke compelling mechanism to prevent the tool from being operated only partially thereby making an ineffective crimp.

Housed respectively in each of first and second jaws 12 and 14 are a pair of crimping dies 40 and 42. Dies 40 and 42 are of conventional construction and are supported in the jaws adjacent nose portion 11. Each of the dies include plural, mutually configured die nests **40*a* and 42*a*** therein for supporting an electrical contact thereinbetween.

Crimping tool 10 is operated in a manner known in the art. A connector is placed between the die nests of dies 40 and 42 and the tool is operated to crimp an electrical connector around an electrical wire inserted therein. The tool 10 operates in two cycles. The crimping cycle moves movable jaw 14 into contact with stationary jaw 12. This cycle crimps a connector supported therebetween. A release cycle moves jaw 14 away from contact with jaw 12 to remove the crimped connector.

Still referring to FIG. 1, the support apparatus of the present invention is shown. Support apparatus 50 is pivotally supported at pivot pin 19 for disposition adjacent the nose 11 of tool 10. The support apparatus 50 is supported on one side of tool 10 so as not to interfere with the operation of jaws 12 and 14.

Referring now to FIGS. 2 and 3, support apparatus 50 is shown in further detail. Support apparatus 50 is a metal member comprising a main body portion 52 and an extending connector accommodating portion 54. It is understood that support apparatus 50 may also be formed of a suitably rigid plastic material. Body portion 52 includes a substantially cylindrical opening 56 therethrough for providing pivotal securement of the support apparatus to pivot pin 18 of the crimping tool 10, as shown in FIG. 1. Connector accommodating portion 54 extends from body 52 and has a transverse extent, as shown in FIG. 3. connector accommodating portion 54 includes four substantially cylindrical longitudinal cavities 58, each for accommodating a circular contact (FIGS. 6 and 7) as will be described in greater detail hereinbelow.

Referring now to FIGS. 4 and 5, cavity 58 has a substantially hollow cylindrical central bore **58*a* extending longitudinally through connector accommodating portion 54. Cavity 58 opens into the front face 54*a* of connector accommodating portion 54. As will be described in greater detail hereinbelow, cavity 58** is configured to uniquely accommodate a cylindrial connector therein providing both polarization of the connector in the cavity and prevention of rotation of the connector in the cavity upon crimping.

As shown in FIG. 4 cavity 58 includes three radially extending circumferencially spaced channels 60, 61 and 62 which are in communication with the central bore **58*a* of cavity 58. As shown in FIG. 4, lower channels 60 and 61 has a first transverse dimension and upper channel 62** has a second transverse dimension greater than the first transverse dimension. This configuration will provide the unique positional accommodation of the circular connector in the cavity.

Figure 6:
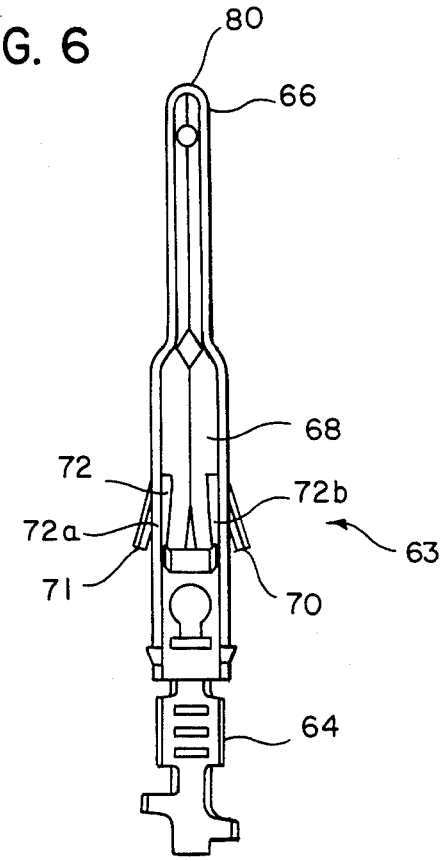
FIGS. 6 and 7 are top and front plan views respectfully, of a cylindrical connector used with the support device of the present invention.
Figure 7:
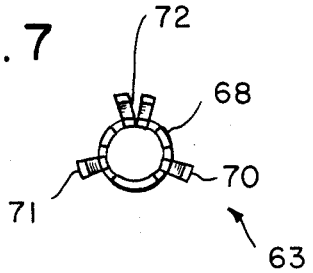
Figure 10:
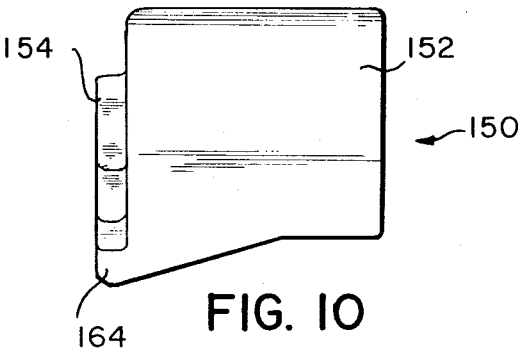
FIGS. 8, 9 and 10 show in top front and side plan views respectfully an alternate embodiment of the support device of the present invention.
Figure 9:
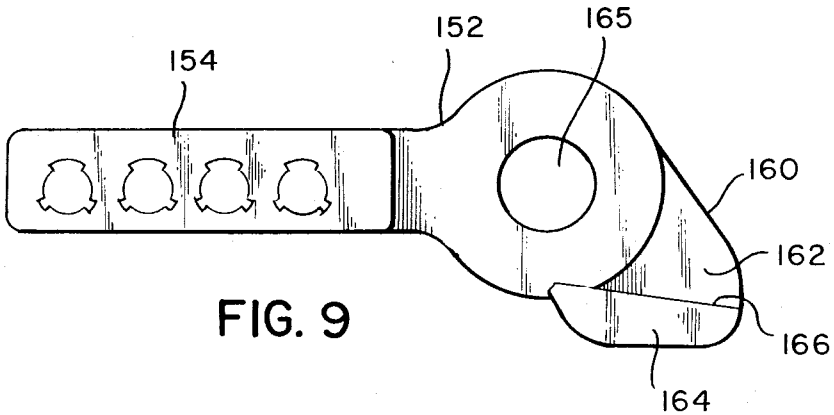

Referring now to FIG. 6, cylindrical contact 63 is described. Cylindrical contact 63 is an elongate electrical terminal having a wire termination end 64, an interconnection tail 66, and a central substantially cylindrical body 68. As shown in FIG. 6, interconnection tail 66 is of the male pin type, however it is contemplated that a female socket tail may also be employed. Cylindrical contact 63 is of substantially conventional construction and is used in a wide variety of connector housings. A bared portion of wire (not shown) is placed in the wire termination end 64 whereupon the termination end 64 may be crimped around the bared portion of the wire using tool 10 to effect wire termination. Central cylindrical portion 68, of contact 63, includes three radially extending circumferencially spaced, projection tangs 70, 71 and 72 which are struck from central body 68. Referring additionally to FIG. 4, each of projection tangs 70 and 71 has a transverse dimension which is uniquely configured to be received in extending channels 60 and 61 respectively of cavity 58. Likewise, tang 72 has a transverse dimension which is greater than tang 70 and 71 so as to be uniquely accommodated in larger channel 62 of cavity 58. As can be seen, cavity 58 will accommodate cylindrical contacts 63 in a singularly unique orientation in the cavity. As the wider tang 72 can only fit in the wider channel 62, contact 63 cannot be inserted in cavity 58 in an incorrect position. Further, the relationship between the tangs of contact 63 and the channels of cavity 58 also provide an anti-rotational feature. The channels 60, 61 and 62 of cavity 50 each have a transverse dimension which is slightly greater than the transverse dimension of the respective tangs 70, 71 and 72 which are inserted therein. Significant rotation of the contact 63, in channel 58 will be prevented. Referring specifically to channel 62, opposed radially extending sidewall **62*a* and 62*b* serve as stop surfaces which engage the side walls 72*a* and 72*b* respectively of tang 72 upon an attempt to rotate circular contact 62 in cavity 58. The engagement of side walls 62*a* and 62*b* of channel 62 with sidewalls 72*a* and 72*b* of tang 72 serve to prevent substantial rotation of the contact 63 in cavity 58. Likewise, it can be seen that the relationship between channel 60 and 61 and tangs 70 and 71** serve a similar function.

Referring again to FIG. 3, cylindrical contact 63 is shown inserted in cavity 58 of connector accommodating portion 54. Wire termination end 64 remains exterior of channel 58 so that a bared extent of electrical wire (not shown) may be inserted therein. Contact 63 is longitudinally positionally located in cavity 58 by providing a stop surface in the form of a back wall 69, as shown in FIG. 5. Back 69 engages the end portion 80 of connection tail 66 of contact 63. This engagement of end portion 80 and back wall 69 provides longitudinal positional confinement of contacts 63 in cavity 58. Appropriate stop surfaces are also provided for providing longitudinal positional confinement of a female socket contact (not shown).

A further feature of the present invention is shown in FIG. 4. In addition to providing antirotation and polarization of the contact 63 in cavity 58, cavity 58 is also uniquely constructed to dispose contact 63 in a precise crimping position with respect to crimping dies 40 and 42 of tool 10 as shown in FIG. 1. FIG. 4 shows cavity 58 disposed in a position where the cavity is rotated in the clockwise direction, thus forming an angle between vertical line "V" and the center line of cavity 58 which extends through the center of channel 62, each which intersect point "0" the origin of circular cavity 58. It has been found that the optimum angle is approximately four degrees with the tolerance of a quarter of a degree. This slight clockwise rotation, positions the contact 63 providing an optimum position for the contact with respect to the dies 40 and 42, which move in a respective accurate path upon crimping.

Various other modifications may be made of the present invention to provide more advantageous positioning of the contact with respect to the die nest 40 and 42 of the tool 10. For example, support member 50 may be spring biasingly supported to the tool 10 so that the wire termination portion 64 of contact 63, extending out of connector accommodating portion 54, (FIG. 3) will be urged against either the upper or lower die to more securely support the contact in the die nest. In addition, various numbers and sizes of cavities may be employed in the connector accommodating portion 54 to correspond to the number of nests in dies 40 and 42 and also to accommodate various sizes and configurations of contacts and gauges of wire.

An alternate embodiment of the present invention is shown in FIGS. 8–12. Support apparatus 150 is substantially similar to support apparatus 50 shown hereinabove and therefore, like reference numerials will denote like parts. Support appartus 150 includes a body portion 152 having a substantially cylindrical opening 156 therethrough for providing pivotal securement to the crimping tool 10. Connector accommodating portion 154 extends from body 152 and includes four substantially cylindrical longitudinal cavities 158 for accommodating circular contacts 163 as described hereinabove. Adjacent central bore 158 is a support stop member 160 which extends downwardly and outwardly from body 152. Stop member 160 includes a baring surface 162 and an abutment surface 164 at the lower end thereof.

Figure 8:
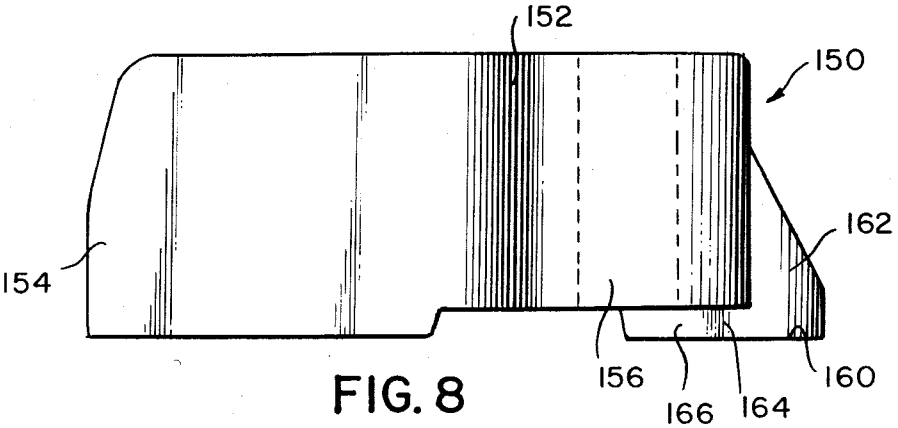
Figure 11:
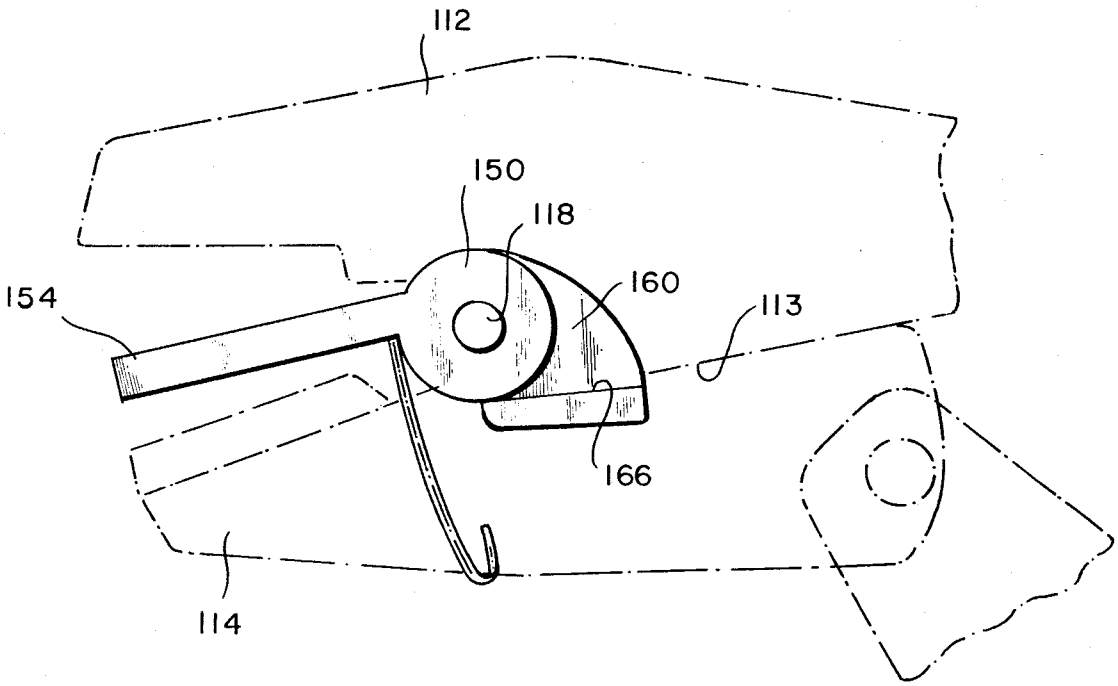
FIGS. 11 shows a support device attached to the front end of the crimping tool which is shown in phantom with the crimping tool shown in the open position.
Figure 12:
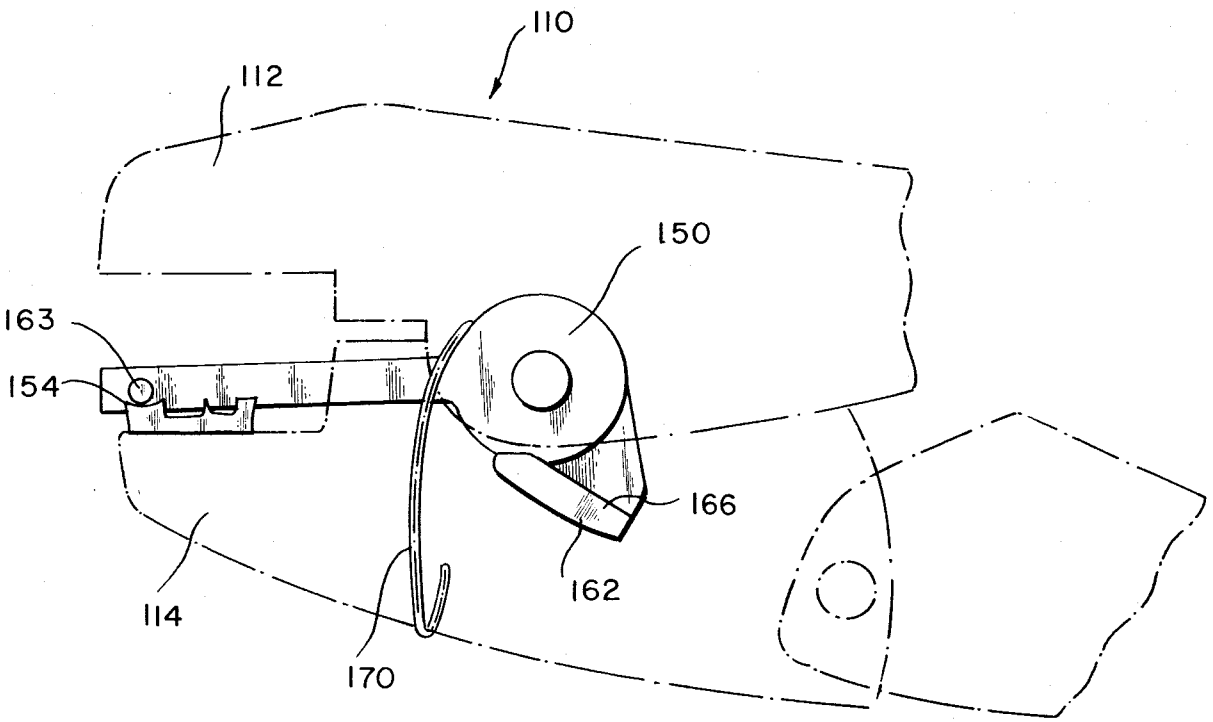
FIG. 12 is a showing of the support device in crimping tool of FIG. 11 with the crimping tool positioned in the crimped position.

Referring to FIGS. 11 and 12, the operation of support apparatus 150 may be shown. Support apparatus 150 is supported adjacent the front end of tool 110 in a similar manner to that described hereinabove. The support member further includes a spring element 170 which is in the form of a coil spring which spring biasingly secures support apparatus 150 about pivot pin 18. This spring securement provides for a spring urging of the connector accommodating portion 154 down toward the lower second jaw 114 as shown in FIG. 8. This spring urging permits the connector accommodating portion 154 to be fixedly located with respect to the jaws 112 and 114. Thus, the connector accommodating portion 154 will always be positioned in a given orientation with respect to the jaws, thereby eliminating an additional location step which would have to be practiced by the installer. However, without restraint on the spring urging forces of spring 170 the connector accommodating portion 154 would be urged downwardly past the location of jaw 114 thereby interfering with the insertion of a connector in cable accommodating portion 154. This would require the user to manually lift the connector accommodating portion 154 against the bias of spring 170 away from jaw 114 to insert the connectors prior to crimping and again to remove them after crimping. In order to prevent the connector accommodating portion 154 from seating at or below lower jaw member 114, stop surface 160 is employed.

As shown in FIG. 11, in open position the crimping tool 110 includes thereon support member 150. Connector accommodating portion 154 is supported roughly equally distant from jaw 12 and 114 as stop surface 162 engages the lip 113 formed by jaw 12 adjacent pivot pin 118. The engagement of stop surface 162 with lip 113 prevents the support apparatus 150 from being spring biasingly further downward toward lower jaw 114. This permits the connectors to be inserted into connector accommodating portion 154 without any interference by the dies (not shown) held in jaws 112 and 114.

Referring now to FIG. 12, as the tool 110 is moved into the crimp position during the crimping cycle a contact 163 held in connector accommodating 154 will engage and contact lower crimping die 42 upon closure of the tool 110 and movement of movable jaw 114. As the contact 163 is supported in connector accommodating portion 154 further closure of tool 110 will urge contact accommodating portion upwardly against the bias of spring 170 about pivot pin 118 for movement in the diretion of and along with the movement of movable jaw 114. Stop surface 166 will be moved off of lip 13 as the support apparatus 150 is pivoted about pin 118. Thus, support apparatus 150 will move along with lower jaw 114 upwardly toward upper jaw 112 during the crimp cycle. After crimping and upon opening of the jaws, as is again shown in FIG. 11, the support apparatus will move downwardly away from jaw 112 under the urging of the bias of spring 170 until stop surface contacts lip 113. Lower jaw 14 will continue to move downward thereby positioning the contact accommodation portion 154 immediately between open jaws 112 and 114. Positioning the contact accommodating member in this location will allow the installer to easily remove the crimp contacts from contact accommodating portion 154.

Various changes to the foregoing described and shown structures would now be evident to those skilled in the art. Accordingly, the particularly disclosed scope of the invention is set forth in the following claims.

I claim:

1. A device for crimping an electrical contact having a substantially circular cross-section comprising:

an actuatable crimping tool having a stationary jaw and a movable jaw, said movable jaw being movable toward said stationary jaw in a crimping cycle and away from said stationary jaw in a release cycle; and a body pivotally movably supported to said tool adjacent said jaws under the bias of a spring, said body being movable with respect to said movement of said movable jaw;

said body including a contact accommodation portion having a longitudinal cavity therein for supporting said contact and placing a portion of said contact between said jaws;

said contact accommodating portion including means for preventing rotation of said circular contact in said cavity with said cavity having a circular cross-section; said tool further including a stop surface thereon adjacent said jaws and wherein said body further includes a stop surface engaging member engageable with said stop surface for limiting movement of said body upon movement of said movable jaw in said release cycle.

2. A device in accordance with claim 1 wherein said body is movable in a direction corresponding to the movement of said movable jaw.

* * * * *

UNITED STATES PATENT AND TRADEMARK OFFICE

CERTIFICATE OF CORRECTION

PATENT NO. : 4,736,614

DATED : April 12, 1988

INVENTOR(S) : Charles T. Fryberger

It is certified that error appears in the above-identified patent and that said Letters Patent is hereby corrected as shown below:

Column 2, lines 45, 52 and 56, change "respectfully" to --respectively--.

Column 3, line 54, change "connector" to --Connector--.

Column 4, line 46, change "sidewall" to --side walls--.

Signed and Sealed this

Fifteenth Day of November, 1988

*Attest:*

*Attesting Officer*

DONALD J. QUIGG

*Commissioner of Patents and Trademarks*